United States Patent [19]

Sinkow

[11] Patent Number: 4,905,388

[45] Date of Patent: Mar. 6, 1990

[54] ORGANIZER AND REMINDER DEVICE FOR PILLS, MEDICINES AND THE LIKE

[76] Inventor: Judith Sinkow, 27733 SW. 140 Ave., Naranja Lakes, Fla. 33032

[21] Appl. No.: 343,740

[22] Filed: Apr. 27, 1989

[51] Int. Cl.[4] ..... G09F 3/00

[52] U.S. Cl. ..... 40/110; 40/107; 40/119

[58] Field of Search ..... 116/308; 40/107, 120, 40/119, 110, 122; 206/534, 459

[56] References Cited

U.S. PATENT DOCUMENTS

| | | | |
|---|---|---|---|
| 1,051,495 | 1/1913 | Fisher | 40/119 |
| 2,341,599 | 2/1944 | Dang | 40/107 |
| 3,099,352 | 7/1963 | Aven | 40/107 X |
| 3,191,319 | 6/1965 | Waisgerber | 40/119 X |
| 3,975,848 | 8/1976 | Schmid | 40/110 |
| 4,749,085 | 6/1988 | Denney | 206/459 X |

FOREIGN PATENT DOCUMENTS

| | | | |
|---|---|---|---|
| 445441 | 2/1949 | Italy | 40/110 |
| 2178007 | 2/1987 | United Kingdom | 206/459 |

*Primary Examiner*—James R. Brittain

*Attorney, Agent, or Firm*—Malloy & Malloy

[57] ABSTRACT

An organizer and reminder device generally presented in a calendar format for the reminder of the user to take certain pills, medicines, etc. on indicated days of the month by providing a plurality of containers secured on a mounting panel through windows representative of days of the month and formed in a plurality of stacked sheets wherein each sheet is representative of a different month of the calendar year and an exposed one of the stacked sheets is representative of a current month. One or more pills, medicines, etc. to be taken on a given day of the month are located in an appropriately positioned container.

14 Claims, 2 Drawing Sheets

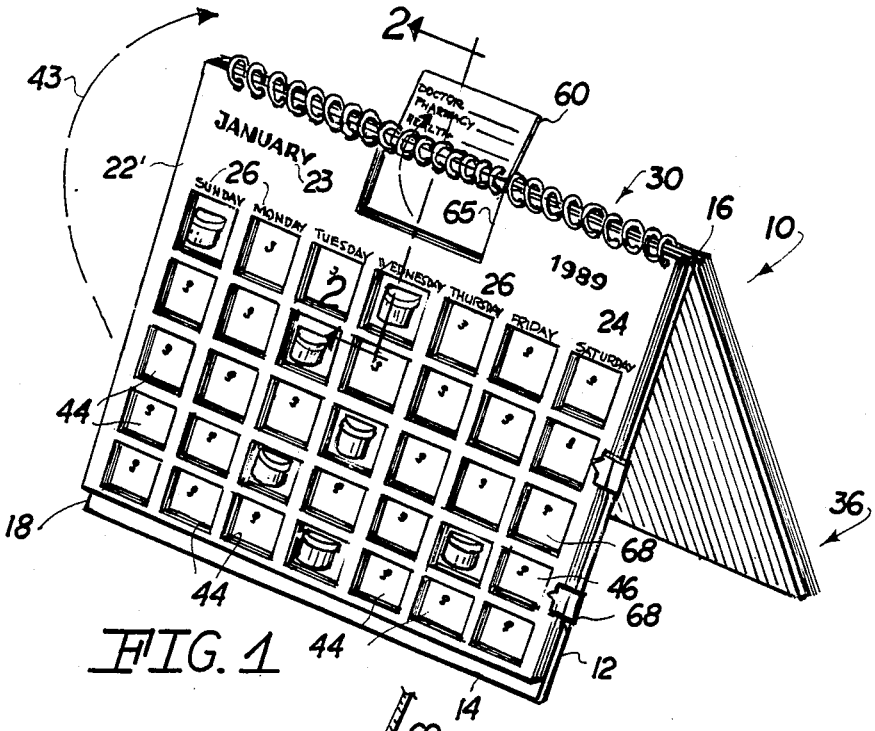
FIG. 1
FIG. 2A
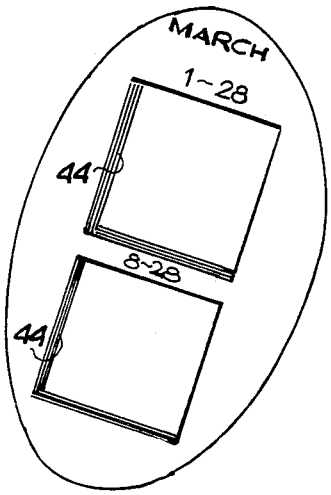
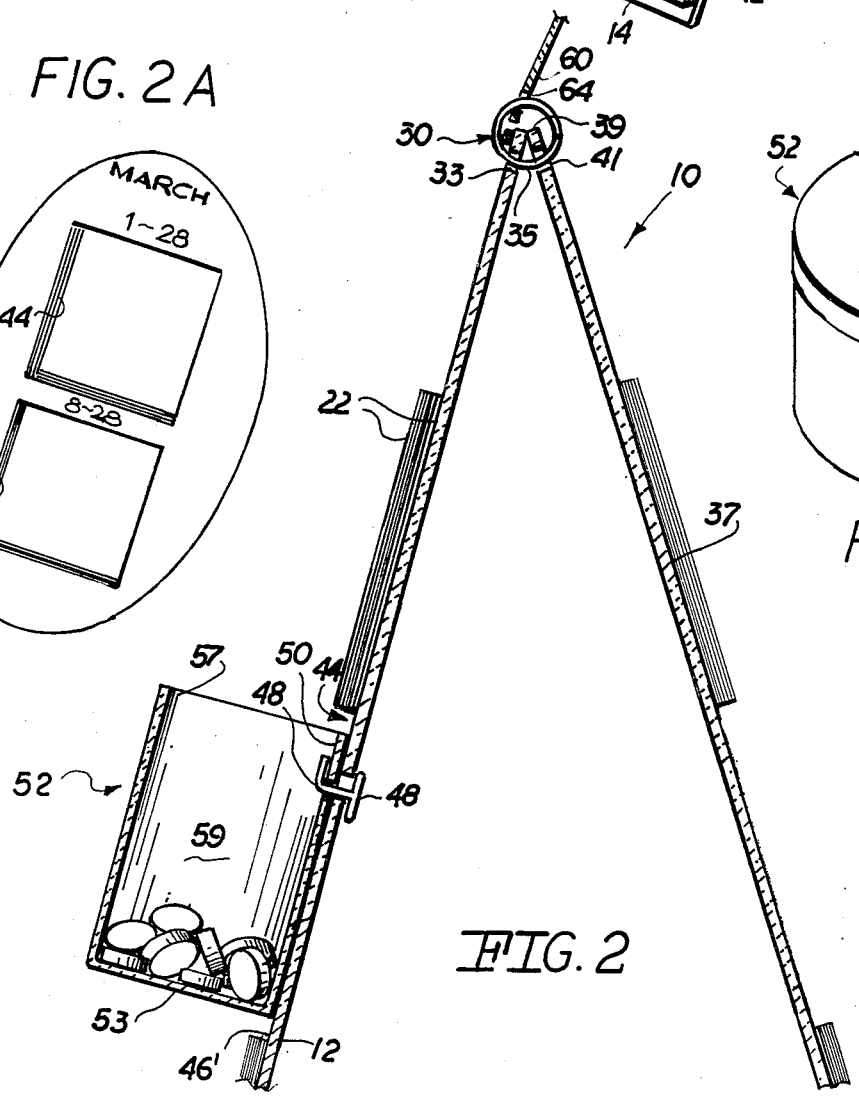
FIG. 2
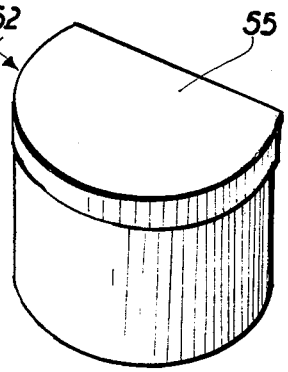
FIG. 3

ORGANIZER AND REMINDER DEVICE FOR PILLS, MEDICINES AND THE LIKE

BACKGROUND OF THE INVENTION

1. Field of the Invention

A calendar type structure used to organize and/or remind a user to consume certain pills, tablets or like medicines, vitamins, etc. on a given day of the month, as intended, wherein each day of each calendar month may be clearly indicated along with facilities for containing or storing pills, medicines, etc. to be consumed on a given day.

2. Description of the Prior Art

In today's modern day, health conscious society where medical care is normally readily available, it is quite common for the average person to take vitamins, medicines, or the like generally in the form of a pill, capsule or the like periodically throughout a given period of time such as a week or month. Obviously, taking of more than one medicine or ingredient at various times throughout the week or month may easily become confusing which results in failure of a patient or consumer to take the proper dosage.

In an effort to overcome this problem, attempts have been made to devise reminders or like devices wherein a user thereof is reminded to take one or more medicines, vitamins, etc. on a given day. Representative of prior art structures set forth above include numerous United States Patents such as Hunger, U.S. Pat. No. 3,207,421 disclosing a reminder device having a sheet with a plurality of transparent flexible material pockets designed to hold any number of different types of objects including but not necessarily limited to medicines, pills or the like. This device is also capable of holding notes which may serve as reminders, etc.

Katz, 3,278,010 discloses a reusable pill dispensing unit having certain mechanical features with operative dispensing components. While operable for its intended function, the device may be somewhat overly complicated due to its mechanical functioning.

Cherrin, 3,432,951 discloses a compartmented container being segregated to represent different days of the week and structured to hold one or more pills in each such segregated compartment such that the proper pills will be taken on the proper day. The strip-like structure may be folded upon itself due to the flexibility of the material from which such a container is utilized. There is no indication of an upstanding or upright mounting or support structure which will enable continuous viewing of the device.

Hayes, 3,579,883 and Dubbels, 3,494,322 disclose pill dispensing packages or containers wherein a number of pills are preferably dispensed directly from the container on a daily basis. Such dispensers may be primarily directed to the user who is interested in taking birth control pills on a prescribed basis.

The patent to Moe, 3,537,422 discloses dispensers preferably for medical preparations in tablet form having a body with several spaces or compartments therein and a cover movable stepwise relative to the dispenser body so that the spaces or compartments are uncovered one after the other consecutively and further wherein the dispenser is meant to be reusable.

While each of the above noted structures being representative of advancements in the prior art are considered to be operative for their intended function, none are specifically designed to include the efficiency and consumer compatibility which overcomes all of the numerous problems recognized in the prior art.

SUMMARY OF THE INVENTION

This invention relates to an organizer or reminder device specifically designed to remind a user thereof to take pills, tablets, such as medicines or vitamins, on the intended or prescribed day during the month. More specifically, the device comprises a mounting panel which may be formed of at least partially or semi-rigid material and a plurality of sheets connected thereto. In a preferred embodiment, to be described in greater detail hereinafter, the plurality of sheets are at least equal in number to the number of months of the year and each of the sheets are movably disposed in a somewhat supported position and in an exposed orientation in overlying relation to the cover sheet. The sheets also preferably are of a common configuration and dimension and may be disposed in a stacked array due to their interconnection to the mounting panel preferably along one common edge of both the sheets and the mounting panel. Accordingly, as each month of the year progresses, a given one of the plurality of sheets representing the month is turned from an outwardly exposed position to a somewhat hidden position thereby allowing the next consecutive sheet, representing the next consecutive month, to be exposed as the leading or frontal sheet of the stacked array. While obviously the sheets and the mounting panel may have any of a variety of configurations and be movably interconnected to one another at any of a variety of locations, one embodiment includes a connecting means. This connecting means serves to allow rotational movement of each of the sheets from the stacked array about a commonly disposed edge or side of the panel to a somewhat hidden or non-observant location. Such movement of the topmost or exposed sheet thereby allows the next consecutive sheet, representing the next consecutive month, to be displayed.

An important feature of the present invention is the inclusion of a plurality of windows in each sheet. The number of windows are at least equal to the number of days of a given month. Preferably, the array of windows in each sheet comprises five rows having seven windows in a row. The windows of each sheet are congruently dimensioned and configured and disposed in a coaxial alignment such that when the sheets are disposed in the aforementioned stacked array, a frontal face of the mounting panel is exposed therethrough. As will be emphasized in greater detail hereinafter, each of the windows in effect represents a day of the month.

Another important feature of the present invention is the existence of a plurality of containers each of which are dimensioned and configured to hold a plurality of pills, tablets, capsules, etc. therein and each being further dimensioned and configured to pass through any of the windows of the plurality of sheets into supported engagement on the exposed frontal region or segment of the front face of the panel viewable through the windows of the stacked array of sheets. Removable interconnection of each of the containers is accomplished by a mounting means which may take any of a variety of structures but which preferably include one connector accessible through each coaxially aligned stack of windows. Each connector in each window stack is thereby capable of having one container mounted thereon.

As each day of the month passes, the user of the subject device merely has to check the container for that particular day and consume all of the pills, tablets, etc. contained therein. Obviously, the containers are prefilled prior to the beginning of the month and such containers are properly placed in the region of the frontal face of the mounting panel in registry with the stacked windows representing a particular day.

Naturally, indicia means is formed on the front face of each sheet indicating month, year, day of the week and calendar day, 1 through 31 or as appropriate.

Other structural features may include one or more indicators connectable to the exposed or viewable sheet representing a given month and locatable on such sheet as a clear indication that a prescription must be renewed or that a supply of given pills, tablets, etc. has been or is close to being expended. In cooperation with the indicators, a tab having informational indicia thereon such as doctor, pharmacy, telephone number, etc. may be structured and connected to the panel and positionable between a clearly viewable or exposed position and a retracted or hidden position so as to facilitate reordering of a given prescription.

Further, a support means may be mounted on the support panel and one embodiment may be a semi-rigid support panel connectable to the mounting panel along the same edge or side as is the remainder of the plurality of "monthly" sheets. Such support panel may be positioned on a supporting surface so as to dispose the plurality of sheets, mounting panel, mounted containers, etc., in an upright, accessible location for viewing and to provide clear access to the containers for the removal of the tablets therein. Naturally, other ways of supporting the subject device are adaptable to the construction to be set forth in greater detail hereinafter.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which:

FIG. 1 is a perspective view of the organizer and reminder device of the present invention.

FIG. 2 is a sectional view taken along line 2—2 of FIG. 1.

FIG. 2A is a detail view of the embodiment of FIG. 2.

FIG. 3 is a detailed view in perspective of one of the plurality of containers used in combination with the device of FIG. 1 and FIG. 2.

Like reference numerals refer to like parts throughout the several views of the drawings.

DETAILED DESCRIPTION OF THE PREFERRED EMBODIMENT

Figure 4:
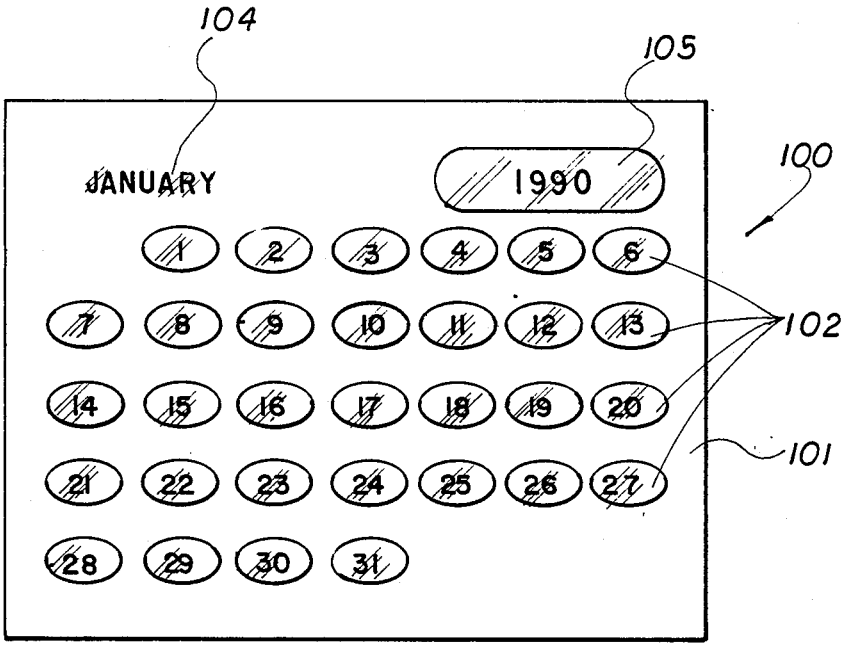
FIG. 4 is a front plan view of a replacement sheet with certain name indicia movably secured thereto.

As shown in FIGS. 1 and 2, the present invention is directed towards an organizer and/or reminder device generally indicated as 10 comprising a mounting panel 12, which in the embodiment shown in FIG. 1, has a somewhat rectangular configuration including a bottom-most edge or side 14, an oppositely disposed upper edge or side 16 and two side edges 18 and 20 extending therebetween.

Further, the device 10 includes a plurality of sheets 22 being preferably at least twelve in number (although a lesser number of sheets may be used) wherein each sheet is representative of at least one calendar month of the year. Further, as shown in FIG. 2 and represented by the monthly sheet of "January" as at 22', indicia means is formed on the exposed face thereof wherein such indicia means may represent the month 23, the year 24, the various days of the week as at 26, and the various numerical days of the month as at 28. Each of the plurality of sheets 22 are preferably of a common configuration and dimension so as to be arranged in a somewhat stacked array and be movably disposed to and from such stacked array by a connecting means generally indicated as 30. While the connecting means may vary in structure, it is preferably constructed to movably interconnect a commonly disposed side or edge of the plurality of sheets 22 as well as side or edge 16 of the mounting panel 18. In the embodiment shown, the connecting means is a continuous spiral connector member passing through appropriate apertures in the uppermost edge of the plurality of sheets 22 and the upper side or edge 16 of the mounting panel 12 as at 33 and 35 respectively. By virtue of this construction, each of the plurality of monthly sheets 22 may be selectively and independently rotated about the connector means 30 from an exposed position or from a position defining the stacked array of sheets as shown both in FIGS. 1 and 2 to a non-exposed position in overlying and somewhat supporting relation to a support panel 36. The support panel 36 may define a portion of or at least one embodiment of a support means used to maintain the device 10 in an upright exposed relation as clearly shown in FIG. 1. Preferably, the support panel 36 is formed with a somewhat rigid material or at least semi-rigid material and has a lower edge 38 also engaging the support surface common to the engaging support of the lower edge or side 14 of the mounting panel 12. The upper edge as at 39 is apertured as at 41 to receive the connector means 30 also allowing swinging or rotational movement of the support panel relative to the mounting panel and the plurality of sheets 22. Directional arrow 43 is indicative of one manner of rotating the last exposed sheet 22' to a non-observant position such that its frontal surface is in confronting relation to the surface 37 of the support panel 36.

An important feature of the present invention is the existence, in each sheet 22, 22', of a plurality of windows generally indicated as 44. The windows are arranged in a predetermined array comprising five rows wherein each row contains seven windows and each window represents a different day of the week and/or month. The particular defined array is clearly shown in FIG. 1. The windows 44 of each sheet are correspondingly and congruently dimensioned, configured and disposed so as to be substantially coaxially aligned with one another. Accordingly, when the sheets 22 are arranged in the aforementioned stacked array as shown in FIGS. 1 and 2, the coaxial displacement of the correspondingly positioned windows of each sheet will expose a region 46 of the frontal surface or face of the mounting panel 12.

A mounting means comprising a plurality of mounting members such as hooks 48 are formed to extend outwardly from the frontal surface 46' of the mounting panel 12 so as to cooperate with an aperture 48 formed in a rear wall 50 of each of a plurality of containers generally indicated as 52. It should be readily apparent therefore that each of the containers 52 may be removably disposed within a stacked coaxially aligned windows of the plurality of sheets when they are disposed in a stacked array as described above and clearly pictured in both FIGS. 1 and 2.

Prior to the beginning of each month, the user merely determines what days he or she is to take certain pills, capsules, etc., and places the appropriate number of pills, tablets, etc. in individual ones of the containers. These filled containers are next positioned in supported relation in the stacked array of windows representing a particular day of the month. As the month progresses, the user merely checks every container of the current day to see if any pills exist on the hollow interior thereof. If no pills exist within a given container for a given day, then no tablets or pills need be consumed on that day. Alternately, the user may avoid placing any container in the aligned registry with a given day. Naturally, if pills do exist in a container for a given day then such pills are consumed on that day as indicated.

As shown in FIG. 2, each of the containers 52 preferably includes a somewhat flat bottom as at 53 as well as a flattened rear wall 50 as set forth above. This allows the rear flattened wall 50 to confront the exposed region 44 of the frontal surface 46' of the mounting panel 12. Further, the flattened surface 53 of the base allows the container to stand by itself to facilitate refilling thereof on a regular basis. A cover, which may be removable, as at 55 may be disposed in covering relation to an open mouth as at 57 if convenient. Alternately, the open mouth 57 may be left uncovered so as to facilitate ready access to the hollow interior 59 of the container 52.

Other structural features include an information tab as at 60 having a plurality of informational indicia formed thereon such as doctor and pharmacy name, appropriate phone numbers, etc. Such informational tab 60 may be selectively positioned between an exposed viewable position as shown shown in FIG. 1 or passed downwardly through appropriately positioned slots as at 62 formed in an upper portion of each of the plurality of sheets 22, 22' and/or the support panel 12. The informational tab 60 is connected to the connector means 30 by an aperture 64 being formed therein.

Other structural features include one or more indicator members as at 68 removably attached to an exposed one of the sheets as at 22' adjacent an appropriate window or window stack. The placement of such indicator 68 may be through a removable clip or like member structured for easy attachment and detachment from the plurality of sheets 22. Placement of the indicator member 68 is to indicate to the user when replacement of pills, tablets, is due or when a prescription needs to be refilled.

Figure 5:
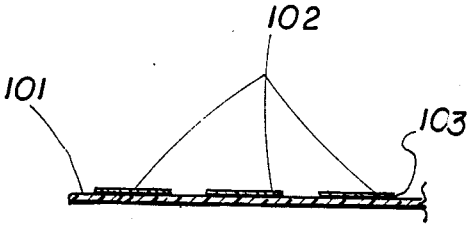
FIG. 5 is a sectional view of a portion of the embodiment of FIG. 4.
Figure 6:
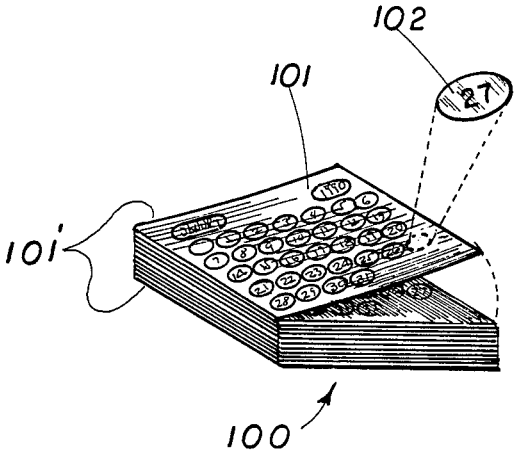
FIG. 6 is a perspective view of a plurality of such sheets each sheet representing a calendar month for a plurality of years such as three years.

FIG. 4 through 6 represents another embodiment of the present invention which may be defined as replacement parts to the assembly as represented in FIGS. 1 and 2. More specifically, a plurality of sheets 100 may be provided and accompany the assembly and the embodiment of FIG. 1. Such sheets 100 may be collected as of 101' and bound or otherwise secured together. Each sheet 100, 101 represents one calendar month of a different year. The plurality of such sheets 101' represents collection of a plurality of years, such as three years. Therefore, the plurality of sheets are 101' includes one sheet for each calendar month for a three year period of time.

On each sheet are replacement indicia for numbers 1 through 31 or the appropriate numerals for the days of a given calendar month. In addition a segment 105 may represent indicia for a different year. The embodiments of FIGS. 4, 5 and 6 are used n combination in with the structure of FIG. 1 by first removing the designated indicia segment 102 or 105 and placing it over the appropriate numeral or year on the calendar month, for example, January, in FIG. 1. The indicia segments representing the different numbered are removed, due to a removable adhesive backing from the sheet 101 and placed on the appropriate calendar month sheet, for example, January, of the sheets of the structure of figures . Similarly, the year indicia segment indicating that the year 1990 is now appropriatly is placed on the 1989 indicia formed on the calendar sheet for January etc. Each of the segments 102 and 105 have a removable adhesive backing as at 103 and may be easily removed from the face of the sheet 101 on whatever on the appropriate sheet of the structures of FIG. 1.

By virtue of this addition the calendar structure as represented in FIGS. 1 and 2 may last for a number of years dependent upon the number of indicia sheets 101' supplied.

Now that the invention has been described, what is claimed is:

1. An organizer and reminder device for receiving pills sorted in daily doses to be temporarily stored for use on preselected dates comprising:

(a) a mounting panel having a front and a rear main face and an upper, lower edge and side edges, (b) a plurality of sheets arranged in a stack array, each of the sheets having an upper, lower and side edges overlaying the panel and including means to secure the plurality of sheets to the panel at their respective upper edges to accommodate swinging movement of the sheets selectively about their respective upper edges relative to said mounting panel, (c) a plurality of windows of common size formed in the sheets, said windows being arranged in rows and columns defining a pattern common to the sheets of the stacked array and each window of each sheet registering with a window in adjacent sheets when said sheets are in the stacked array, and exposing a plurality of spaced regions of the front face of said mounting panel, (d) indicia on each sheet defining a predetermined time period and identifying the windows of the sheets as increments of the period, (e) a plurality of containers each sized to be disposed on the interior of said windows and mounting means secured to said mounting panel in registry with said plurality of windows of said sheets arranged in the stacked array, said mounting means disposed and structured for removable support of said containers on said mounting panel in an accessible position relative to an exposed one of said pluralities of sheets, and (f) support means connected to said mounting panel for support of said mounting panel, the plurality of sheets and the plurality of containers in an upright, generally erect attitude.

2. The calendar as set forth in claim 1 wherein the support means comprises a rigid rear panel having an upper edge rotatably connected to said mounting panel adjacent the upper edge thereof.

3. The device as set forth in claim 2 wherein the indicia defines a calendar month and there are seven windows in a row and five windows in a column.

4. The device as set forth in claim 1 wherein the indicia defines a calendar month and there are seven windows in a row and five windows in a column.

5. The device as set forth in claim 1 wherein the containers include a flat wall surface disposed to confront one of the regions of the front face of said mounting panel, said mounting means supportingly engaging the containers on said front face.

6. The device as in claim 5 wherein the mounting means comprises mutually interengaging means on the front face in each region and on the flat surface of the container.

7. The device as set forth in claim 1 wherein the stacked array comprises twelve sheets each representing a calendar month and the indicia identify each sheet with the name of a calendar month of a calendar year and each window of each sheet with a number corresponding to a day of each month.

8. The device as set forth in claim 1 further comprising a lid means mounted in covering relation to an open mouth of each container for closing an interior thereof to atmosphere.

9. The device as set forth in claim 8 wherein said lid means comprises a removable cap secured to said open mouth.

10. The calendar as set forth in claim 1 wherein the sheets each have a cutout of common size and location extending from their respective upper edges toward their respective lower edges and between their respective side edges, said cutout being between their respective upper edges and the pattern of windows of the stacked array and a hanging top including means connecting the tab to the upper edge of the mounting panel and the sheets, said tab being sized relative to the cutouts to permit swinging movement of the sheets selectively relative to the front panel.

11. The device as set forth in claim 10 wherein said indicia are provided on the tab to display identifying information.

12. The device as set forth in claim 10 wherein the tab is provided with a hole to accommodate hanging of the mounting panel therefrom.

13. The device as set forth in claim 1 further comprising indicator means mounted on an exposed one of the sheets for designating a selected window to indicate to a user that the supply condition of the contents of the container as of an increment of the period of time.

14. The device as set forth in claim 1 wherein said plurality of sheets are at least equal in number to the twelve calendar months of the year.

* * * * *